US005147180A

United States Patent [19]

Johnson

[11] Patent Number: 5,147,180

[45] Date of Patent: Sep. 15, 1992

[54] OPTIMIZED BLADE ROOT PROFILE FOR STEAM TURBINE BLADES

[75] Inventor: Mike C. Johnson, Winter Springs, Fla.

[73] Assignee: Westinghouse Electric Corp., Pittsburgh, Pa.

[21] Appl. No.: 672,971

[22] Filed: Mar. 21, 1991

[51] Int. Cl.[5] ..... F01D 5/30

[52] U.S. Cl. ..... 416/219 R; 416/223 A

[58] Field of Search ..... 416/219 R, 220 R, 223 A, 416/248, DIG. 2

[56] References Cited

U.S. PATENT DOCUMENTS

| | | | |
|---|---|---|---|
| 3,079,681 | 3/1963 | Fentiman | 416/219 R |
| 4,191,509 | 3/1980 | Leonardi . | |
| 4,260,331 | 4/1981 | Goodwin | 416/219 R |
| 4,692,976 | 9/1987 | Andrews | 416/219 R |
| 4,824,328 | 4/1989 | Pisz et al. | 416/219 R |

*Primary Examiner*—Edward K. Look
*Assistant Examiner*—James A. Larson

[57] ABSTRACT

A turbine blade includes an airfoil portion, a platform portion from which the airfoil portion extends upwardly, and a root portion extending downwardly from the platform portion, the root portion includes in descending order an upper-most root neck, an intermediate root neck, and a lower-most root neck, an upper-most lug being formed beneath the upper-most root neck, an intermediate lug being formed beneath the intermediate neck, and a lower-most lug being formed beneath the lower-most root neck. The upper-most neck includes a first top radius R1 and a second lower radius R2, wherein a length of R1 is about 30% greater than a length of R2.

13 Claims, 3 Drawing Sheets

OPTIMIZED BLADE ROOT PROFILE FOR STEAM TURBINE BLADES

BACKGROUND OF THE INVENTION

1. Field of the Invention

The present invention relates generally to the art of turbomachinery blade design and, more specifically, to an optimized blade root attachment profile which achieves a reduction in local peak stress.

2. Description of the Related Art

A turbine has a plurality of rows of stationary and rotary blades. The blades of one row are usually identical to each other and include an airfoil portion and a root portion. The root portion is used to mount the blade in a mounting groove provided in the rotor for rotary blades or in the cylinder for stationary blades.

A common type of root profile for rotary blades is known as the "fir tree" profile, so-called because of the plurality of necks which define a plurality of radially extending lugs.

In the past, fir tree-type blade root contours have been characterized by two symmetrical curvilinear surfaces disposed on opposite sides of the root center line and joined at the bottom by the root bottom and at the top by a lower side of the blade platform.

U.S. Pat. No. 4,191,505, issued to Leonardi, describes a blade profile in which each neck of the blade root has two different radii, with the larger radius being provided in an upper portion of the neck and a smaller radius provided for a lower portion of the neck. This compound contour of the neck in an area where both bending loads and shearing loads act in concert to place the blade material in severe tension is stated to improve low cycle fatigue life, whereby increasing the first radius and decreasing the second radius enables a reduction in maximum stress without a corresponding increase in root depth.

Large rotary blades, such as the last row of blades in a steam turbine experience relatively high peak root/-groove stress which results from centrifugal loading. A continuing need exists to minimize this peak root/-groove stress, without increasing bearing stress.

SUMMARY OF THE INVENTION

An object of the present invention is to provide a turbine blade root portion which is capable of minimizing the peak root/groove stress which results from centrifugal loading of a large last-row blade of a steam turbine, without reducing the bearing land widths to the degree which produces unacceptable bearing stress.

Another object of the present invention is to provide a turbine blade root portion which has an optimized relationship between the compound radius of the upper-most root neck and the root neck area to produce a reduction in local peak stress.

Another object of the present invention is to provide a turbine blade root portion which maintains bearing areas large enough to reduce bearing stress.

These and other objects of the invention are met by providing a turbine blade which includes an airfoil portion, a platform portion from which the airfoil portion extends upwardly, and a root portion extending downwardly from the platform portion, the root portion including in descending order an upper-most neck, at least one intermediate neck, and a lower-most neck, and an upper-most lug formed beneath the upper-most neck, at least one intermediate lug formed beneath the at least one intermediate neck, and a lower-most lug formed beneath the lower-most neck, and wherein all necks and lugs have a curved surface defined by an upper pivot center, a lower pivot center and two radial portions, a first radial portion pivoting on the upper pivot center and a second radial portion pivoting on the lower pivot center areas have compound.

These and other features and advantages of the optimized blade profile according to the present invention will become more apparent with reference to the following detailed description and drawings.

DETAILED DESCRIPTION OF THE PREFERRED EMBODIMENTS

Figure 1:
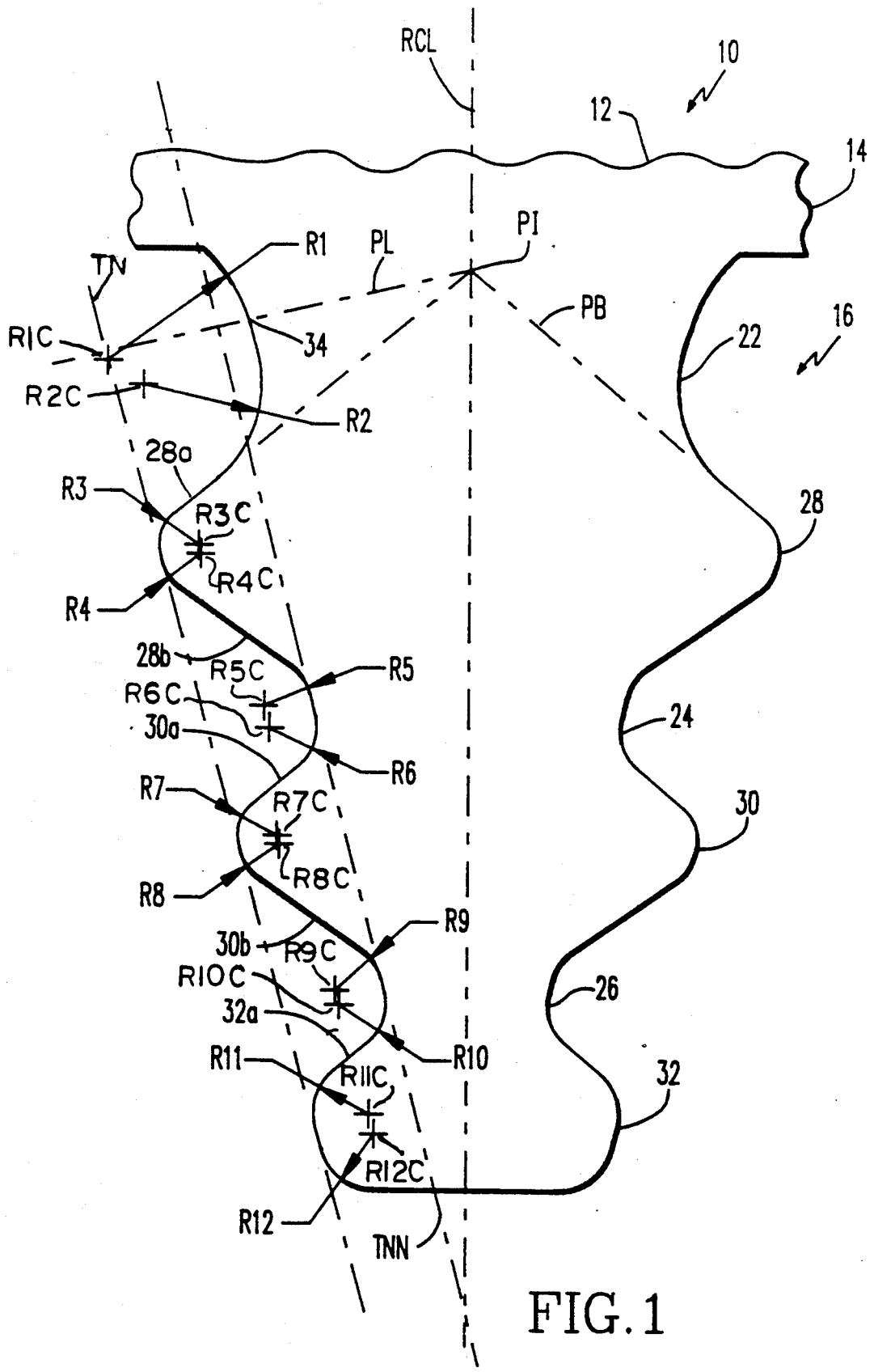
FIG. 1 is an end view showing in detail the root portion of the turbine blade according to the present invention.
Figure 1A:
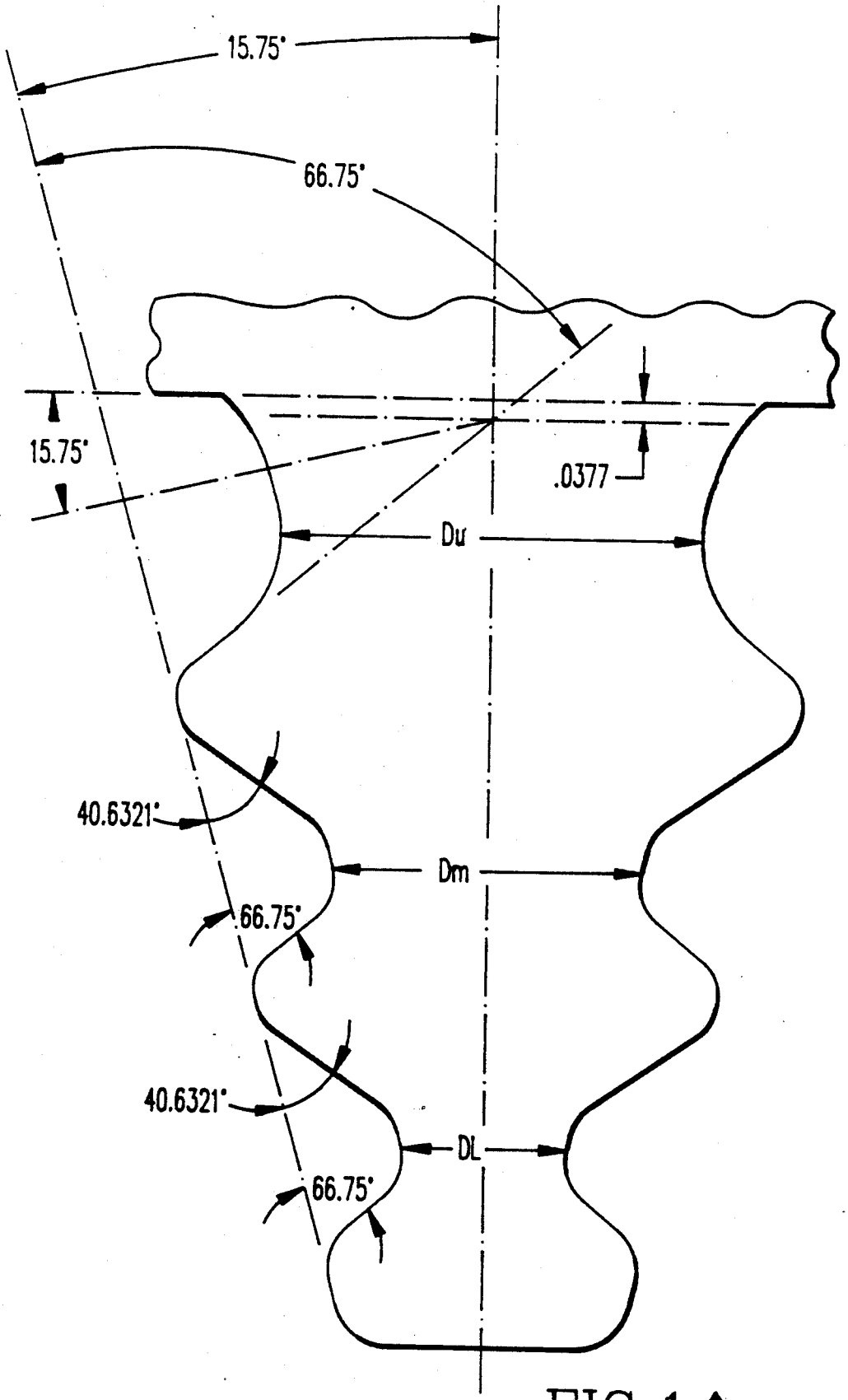
FIG. 1A is an end view showing the angular relationships between the tangent line and the lugs and necks.
Figure 2:
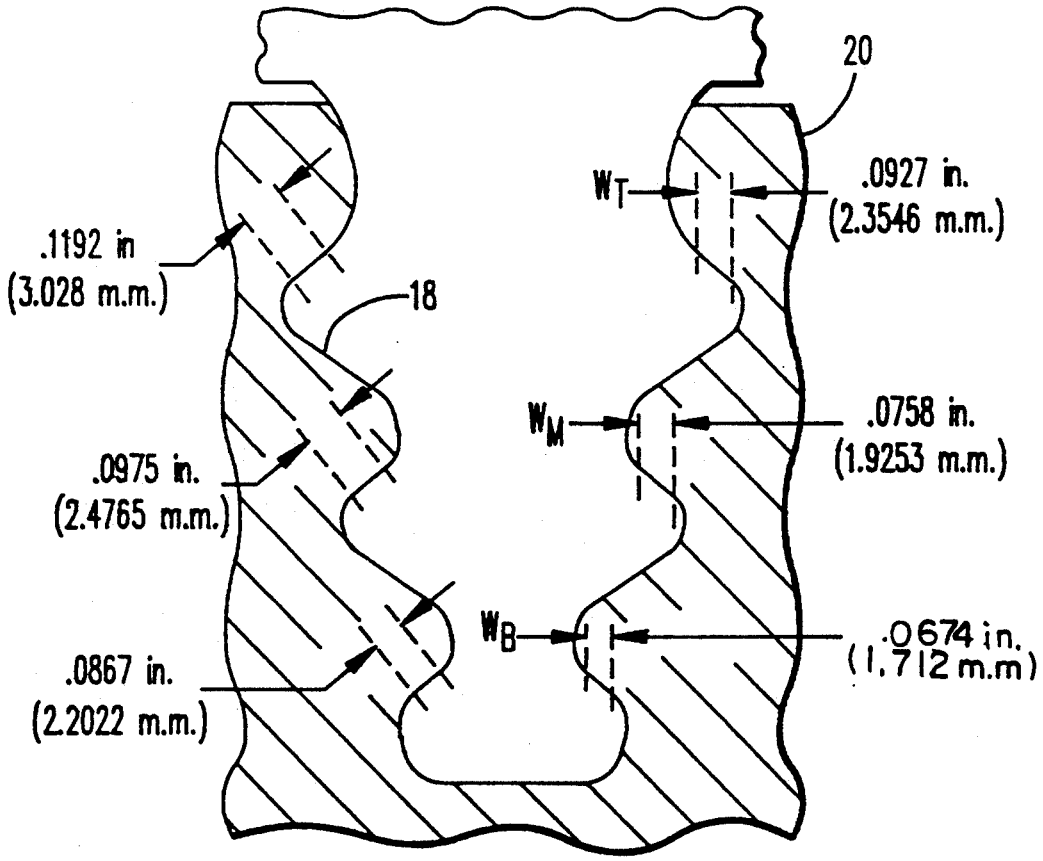
FIG. 2 is an end view showing nominal root-to-groove bearing surface contact.

Referring now to FIGS. 1, 1A and 2, a turbine blade according to the present invention is generally referred to by the numeral 10 and is specifically a large, last-row steam turbine blade. The blade includes an airfoil portion 12 and a platform portion 14, both of which are not shown in detail. A root portion 16 extends downwardly from the platform portion 14 and is fitted within a corresponding mounting groove 18 of a rotor 20.

The root portion 16 includes in descending order an upper-most root neck 22, at least one intermediate neck 24, and a lower-most neck 26. Each neck is formed symmetrically about a root center line RCL by a pair of mirror-image curved surfaces having a unique shape which will be described in more detail below. Each neck has a width indicated by the horizontal lines Du, Dm and DL for the upper-most, intermediate, and lower-most necks, respectively.

An upper-most lug 28 is formed beneath the upper-most neck 22 and is also symmetrically disposed about the RCL. An intermediate lug 30 is disposed beneath the intermediate neck 24, and a lower-most lug 32 is disposed beneath the lowermost neck 26.

The upper-most neck 22, on each side of the RCL, has a compound radius wherein a first radius R1 has a pivot center R1C so as to define a surface which extends from the platform portion 14 to a point of transition 34. At point 34, a second radius R2 is used to complete the neck surface by drawing a curve from a pivot center R2C spaced inwardly of the pivot center R1C. In the preferred embodiment, an optimized neck radius ratio has been established where the top radius, R1, is approximately 30% larger than R2 (R1=0.300" or 7.62 mm and R2=0.230" or 5.842 mm) and radius, R2 is greater than 30% of the top root neck width, Du (R2=0.230" or 5.842 mm and Du=0.7369" or 18.7173 mm). This preferred embodiment allows the root profile to be highly loaded by centrifugal forces while maintaining a minimum peak stress in the root top neck 22. This gives this root profile a superior resistance to low-cycle fatigue.

The pivot center R1C lies on a line TN which is tangent to the outer radial surfaces of the root lugs 28, 30 and 32. The point 34 of transition from the first radius to the second radius is selected by drawing a perpendicular line PL from the tangent TN and passing through a point PI of intersection on the RCL wherein planes PB which include the bearing surfaces of the upper-most lug intersect each other and the RCL.

Each lug has a flat, upper bearing surface, such that lug 28 has a bearing surface 28*a*, lug 30 has a bearing surface 30*a* and lug 32 has a bearing surface 32*a*. In the upper-most lug 28, the bearing surfaces on opposite sides of the RCL intersect at the RCL and thus provide a reference point for the perpendicular line PL which provides the point of transition 34 between the first and second radii of the upper-most neck 22.

In the past, larger neck radii, never as large or proportioned as described above, have been achieved by reducing the bearing surface projections, Wt, Wm, Wb, thus producing a root profile with higher than traditional bearing stresses. In the preferred embodiment, the top bearing surface projection, Wt, is no less than 12.5% of the top root neck width, Du (Wt=0.0927" or 2.3546 mm and Du=0.7369" or 18.7173 mm) and subsequently the middle bearing surface projection, Wm=0.0758" or 1.9253 mm, is no less than 80% of the top bearing surface projection, Wt, and the bottom bearing surface projection, Wb =0.0674 or 1.712 mm, is no less than 70% of the top bearing surface projection, Wt. This preferred configuration enables the root profile to be highly loaded by centrifugal forces while maintaining an acceptable and traditional bearing surface stress.

For the remaining lugs and necks, except for the bottom-most lug, a single radius is used at staggered pivot centers. For example, the outer radial extension of lug 28 is formed by two radius segments of radius R3 and R4. R3 and R4 are equal to each other, preferably 0.0721 inches (1.83134 mm), but the pivot centers R3C and R4C are staggered vertically so as to produce a flattened surface portion between the two radius portions formed by the two radii of equal length.

A flattened surface 28*b* extends at an angle of 40.63212° from the tangent line TN and extends from the lug 28 to the neck 24. Radius R5 and R6, preferably 0.1083 inches (2.751 mm) are drawn from two different pivot centers R5C and R6C which are vertically staggered so as to produce a flattened surface of the neck 24.

Bearing surface 30*a* of the lug 30 is also disposed at an angle 66.75° from the tangent line TN and is thus parallel to the bearing surface 28*a*.

Lug 30 is formed by a single radius R7 and R8 drawn from two staggered pivot centers R7C and R8C. Preferably, R7 and R8 are both 0.0737 inches (1.87198 mm). Flat surface 30*b* is also disposed at an angle of 40.6321° from the tangent line TN and is thus parallel to surface 28*b*.

The neck 26 is formed by a single radius R9 and R10 drawn from two, vertically staggered pivot centers R9C and R10C. Preferably, R9 and R10 are both 0.085 inches (2.159 mm). Bearing surface 32*a*is disposed at an angle of 66.75° to the tangent line TN and is thus parallel to bearing surfaces 28*a* and 30*a*.

The lower-most lug 32 is formed by a first radius R11 and a second radius R12. In this case, R11 is smaller than R12, with R11 being preferably 0.0945 inches (2.4003 mm) and R12 is preferably 0.108 inches (2.7432 mm). The pivot center R11C is vertically staggered from the pivot center R12C, and slightly horizontally offset as well.

From the foregoing, it can be seen that the upper-most neck and the lower-most lug have a compound radius, in which the first radius is larger than the second radius, whereas in the lower-most lug 32 the first radius is smaller than the second radius. The neck radii become smaller from top to bottom, whereas the lug radii become larger from top to bottom.

The overall length of the root portion 16 is 1.989 inches (43.15206 mm). The tangent line TN is disposed at an angle of 15.75° to the RCL, whereas the perpendicular line PL is disposed at the same angle (15.75°).

A tangent line TNN which is tangent to the two necks 24 and 26 is spaced apart from a tangent line which is tangent to the neck 22 by about 0.0782 inches (1.98628 mm). The pivot center R1C is preferably 0.2342 inches (5.94868 mm) from the lower surface of the platform portion 14. The bearing surface 28*a* is 0.5006 inches (12.71524 mm) from the bearing surface 30*a*, and 0.9632 inches (24.46528 mm) from the bearing surface 32*a*. The point of intersection PI is 0.0377 inches (0.95758mm) from the lower surface of the platform portion 14. The upper-most neck 22 has a width of 0.7369inches (18.71726 mm).

The optimized root profile for a turbine blade as described herein has been estimated through computer modeling to achieve substantial gains in the area of reduced local peak stress while maintaining bearing areas large enough to not increase the bearing stress as compared to other designs.

Numerous modifications and adaptations of the present invention will be apparent to those so skilled in the art and thus, it is intended by the following claims to cover all such modifications and adaptations which fall within the true spirit and scope of the invention.

What is claimed is:

1. A turbine blade comprising:

an airfoil portion;

a platform portion from which the airfoil portion extends upwardly; and a root portion extending downwardly from the platform portion; the root portion including in descending order an upper-most neck, an intermediate neck, and a lower-most neck, an upper-most lug being formed beneath the upper-most neck, an intermediate lug being formed beneath the intermediate neck, and a lower-most lug being formed beneath the lower-most neck, and wherein each of the necks and lugs has a curved surface defined by two vertically staggered pivot centers, a first radial portion pivoting on an upper pivot center and a second radial portion pivoting on a lower pivot center, each of the upper-most neck and the lower-most lug having a compound radius wherein the radius of the first radial portion and the radius of the second radial portion are of different lengths, the radius of the first radial portion of the upper-most neck being 30% longer than the radius of the second radial portion of the upper-most neck, each of the uppermost lug, the intermediate neck, the intermediate lug, and the lower-most neck having a single radius length wherein the radius of the first radial portion and the radius of the second radial portion are of the same length, the single radius of the intermediate neck being larger than the single radius of the lower-most neck.

2. A turbine blade as recited in claim 1, wherein the first radial portion of the upper-most neck defines a first portion of the upper-most neck which extends downwardly from the platform portion, and the second radial portion of the upper-most neck defines a second portion of the upper-most neck which extends to the upper-most lug.

3. A turbine blade as recited in claim 1, wherein the radius of the second radial portion of the upper-most neck R2 is greater than 30% of a width of the upper-most root neck.

4. A turbine blade as recited in claim 1, wherein the first radial portion of the lower-most lug forms a first curved portion of the lower-most lug, and the radius of the second radial portion of the lower-most lug is larger than the radius of the first radial portion of the lower-most lug and forms a second curved portion of the lower-most lug and which terminates in a bottom of the root portion.

5. A turbine blade as recited in claim 1, wherein each lug has a flat, upper bearing surface and the first radial portion of the upper-most neck defines a first curved portion of the upper-most neck extending from the platform portion, and the second radial portion of the upper-most neck defines a second curved portion extending from a terminus of the first curved portion to the bearing surface of the upper-most lug.

6. A turbine blade as recited in claim 5, wherein the terminus of the first curved portion is at a point on a line perpendicular to a line mutually tangent to all of the lugs, wherein the perpendicular line passes through the point of intersection between a root center line and a plane encompassing the bearing surface of the upper-most lug.

7. A turbine blade as recited in claim 6, wherein the tangent line is disposed at an angle of about 15.75° to the root center line.

8. A turbine blade as recited in claim 7, wherein the perpendicular line is disposed at angle of about 15.75° to the platform portion.

9. A turbine blade as recited in claim 1, wherein the single radius of the upper-most lug is smaller than the single radius of the intermediate lug.

10. A turbine blade as recited in claim 9, wherein the radius of the first radial portion of the lower-most lug and the radius of the second radial portion of the lower-most lug are both larger than the single radius of the intermediate lug.

11. A turbine blade as recited in claim 1, wherein each of the upper-most, intermediate, and lower-most lug has a bearing surface projection, Wt, Wm and Wb, respectively, each having a length and wherein the length of Wt is at least 12.5% of a width of the upper-most neck.

12. A turbine blade as recited in claim 11, wherein the length of Wm is at least 80% of the length of Wt.

13. A turbine blade as recited in claim 12, wherein the length of Wb is at least 70% of the length of Wt.

* * * * *